United States Patent [19]

Huse et al.

[11] 4,003,671

[45] Jan. 18, 1977

[54] METHOD AND MEANS TO PREVENT CAVITATION EROSION IN PROPELLER DUCTS

[75] Inventors: Erling Huse, Vikhamar; Knut Minsaas, Trondheim, both of Norway

[73] Assignee: Norges Skipsforskningsinstitutt, Trondheim, Norway

[22] Filed: Nov. 26, 1974

[21] Appl. No.: 527,423

[30] Foreign Application Priority Data

Dec. 4, 1973 Norway ..... 4625/73

[52] U.S. Cl. ..... 415/1; 415/116; 60/221; 60/269

[51] Int. Cl.[2] ..... B63H 11/02

[58] Field of Search ..... 415/DIG. 1, 116, 42; 60/221, 269

[56] References Cited

UNITED STATES PATENTS

| | | | |
|---|---|---|---|
| 442,615 | 12/1890 | Dock | 415/116 |
| 2,685,429 | 8/1954 | Auyer | 415/DIG. 1 |
| 2,952,125 | 9/1960 | Brunton | 415/116 |
| 3,132,839 | 5/1964 | Haekel | 415/DIG. 1 |
| 3,230,702 | 1/1966 | Soulez et al. | 415/DIG. 1 |
| 3,499,412 | 3/1970 | Anthes et al. | 415/116 X |
| 3,597,102 | 8/1971 | Unsworth | 415/175 X |
| 3,675,424 | 5/1970 | Oosterveld | 415/DIG. 1 |

FOREIGN PATENTS OR APPLICATIONS

| | | | |
|---|---|---|---|
| 872,010 | 6/1971 | Canada | 415/DIG. 1 |

*Primary Examiner*—Arnold Rosenthal
*Attorney, Agent, or Firm*—Wenderoth, Lind & Ponack

[57] ABSTRACT

The invention relates to a method and a means to prevent cavitation and/or erosion in propeller ducts, and the invention is generally characterized in that air is supplied to the so-called "gap cavities" which are formed at the blade extremities or tips and between blade tips and the duct surface.

10 Claims, 2 Drawing Figures

METHOD AND MEANS TO PREVENT CAVITATION EROSION IN PROPELLER DUCTS

BACKGROUND OF THE INVENTION

The present invention deals with a method and a means to prevent or reduce cavitation erosion in propeller ducts, particularly in so-called "Kort nozzles".

On ships equipped with propeller ducts, cavitation and/or erosion is often created on the inside surface of the duct adjacent or beyond the blade tips. This erosion is due to the so-called "gap cavities" formed at the blade extremities or tips and between blade tips and duct surface.

For smaller vessels this type of cavitation erosion is seldom a serious problem and can generally be avoided by correct hydrodynamic design of propeller and duct or by using stainless steel in the duct surface close to the blade tips. Since 1972 ducted propellers have also been applied to the very large tankers of more than 200 000 TDW. During 1973 and 1974 it has become clear that for such ships cavitation erosion in the duct is a more difficult problem to solve than in the case of smaller vessels. Various investigations are going on in 1974 to solve the problem by improved hydrodynamic design of the propeller and duct. An attempt has also been tried to solve the problem by using various materials or coatings in the duct surface close to the propeller blade tips. Such methods may well be a final solution for ships to be designed in the future. However, ships that are already in service and are suffering from this problem will not benefit from the above mentioned results.

SUMMARY OF THE INVENTION

The present invention provides a method and a means to prevent or substantially reduce such cavitation damage in the duct for built ships, as well as for ships that are already in service. The invention is based upon the principle of supplying air, usually pressurized air, to the "gap cavities", hereinafter simply named "cavities". It is generally known from model testing that a high content of undissolved air in the water may reduce erosion intensity due to the increased compressibility of the water. The present invention, however, is based on supplying air directly into the cavities, thus preventing them from imploding completely. According to the present invention air should be supplied along a part of the duct circumference through holes or other types of outlets connected to one or more compressors on board the ship, if compressors are necessary.

One design would for instance be to supply air by one or more tubes welded to the duct surface, the open ends of the tubes serving as air outlets close to the blade tips, and on their upstream side.

BRIEF DESCRIPTION OF THE DRAWINGS

Such design is illustrated in the enclosed drawings, wherein.

DETAILED DESCRIPTION OF THE INVENTION

Figure 1:
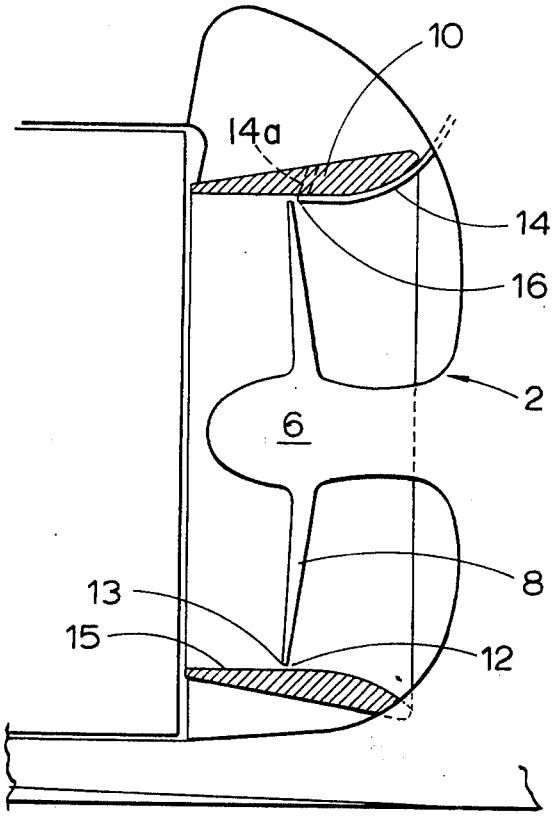
FIG. 1 shows the propeller arch with propeller and duct fitted with air supply according to this invention.

The drawings show the propeller arch contour 2, the propeller 6 with blades 8 in a duct 10 and with the shown clearances or cavities 12 between the duct surface 15 and blade tips 13. These cavities give rise to erosion of the duct.

The drawings show a plurality of tubes welded longitudinally to the inside of the duct, upstream of the propeller and with air outlets at 16. The tubes are connected to compressors.

Figure 2:
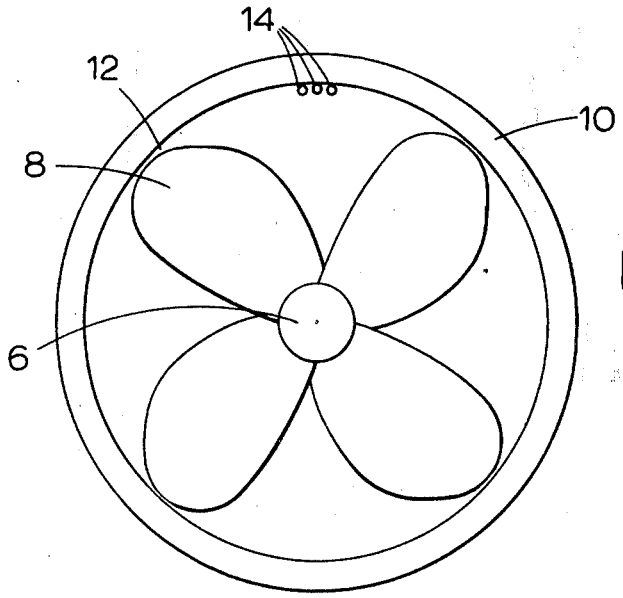
FIG. 2 shows the arrangement seen from aft.

Since the erosion, according to experience, mainly occurs in the area close to the blade tips and after they have passed the wake peak in the upper part of the propeller disc, it will in most cases be sufficient to arrange an air outlet in the top position as shown in FIG. 2. Another possibility is to fit air outlets along a larger part of the circumference, for instance extending to positions 90 °from the top.

Instead of tubes welded to the duct surface, the air can be supplied in other ways, for instance by tubes through the duct profile to holes in the inside plating, as shown schematically at 14*a*. These holes should be positioned just outside the blade tips or some distance upstream therefrom.

We claim:

1. A method for preventing erosion of a ship propeller duct, wherein propeller blade tips rotate adjacent a surface of said duct with the resultant formation of gap cavities therebetween, said method comprising:

supplying air to said gap cavities between said propeller blade tips and said duct surface, by passing air through at least one tube fixed to the inner surface of said duct.

2. A method as claimed in claim 1, wherein said air is supplied to a limited area of the upper half of the circumference of said duct.

3. A method as claimed in claim 2, wherein said air is supplied through a plurality of tubes.

4. A method as claimed in claim 3, wherein said tubes have outlets in said gap cavities.

5. A method as claimed in claim 3, wherein said tubes have outlets upstream of said gap cavities.

6. In a ship structure including a propeller duct and a propeller rotatably mounted therein, said propeller having blade tips rotating adjacent a surface of said duct with the resultant formation of gap cavities therebetween, the improvement comprising:

means for preventing erosion of said duct surface, said means comprising at least one tube means fixed to the inner surface of said duct for supplying air to said gap cavities between said propeller blade tips and said duct surface.

7. The improvement claimed in claim 6, wherein said tube means is positioned adjacent a limited area of the upper half of the circumference of said duct.

8. The improvement claimed in claim 7, wherein said tube means comprises a plurality of tube.

9. The improvement claimed in claim 8, wherein said tubes have outlets in said gap cavities.

10. The improvement claimed in claim 8, wherein said tubes have outlets upstream of said gap cavities.

* * * * *